US012716155B2

(12) United States Patent
Snook

(10) Patent No.: US 12,716,155 B2
(45) Date of Patent: Aug. 25, 2026

(54) LAUNDRY WASHING MACHINE WITH REMOVABLE AGITATOR

(71) Applicant: Wuxi Little Swan Electric Co., Ltd., Wuxi (CN)

(72) Inventor: Bryan T. Snook, Louisville, KY (US)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 102 days.

(21) Appl. No.: 18/607,375

(22) Filed: Mar. 15, 2024

(65) Prior Publication Data

US 2025/0290241 A1 Sep. 18, 2025

(51) Int. Cl.

| | |
|---|---|
| ***D06F 13/02*** | (2006.01) |
| ***D06F 13/00*** | (2006.01) |
| ***D06F 13/04*** | (2006.01) |
| ***D06F 13/06*** | (2006.01) |
| ***D06F 13/08*** | (2006.01) |
| ***D06F 17/10*** | (2006.01) |
| ***D06F 21/08*** | (2006.01) |

(52) U.S. Cl.

CPC ..... *D06F 17/10* (2013.01); *D06F 13/00* (2013.01); *D06F 13/02* (2013.01); *D06F 13/04* (2013.01); *D06F 13/06* (2013.01); *D06F 13/08* (2013.01); *D06F 21/08* (2013.01)

(58) Field of Classification Search

CPC ..... D06F 13/00; D06F 13/02; D06F 13/04; D06F 13/06; D06F 13/08; D06F 21/08; D06F 17/10

See application file for complete search history.

(56) References Cited

U.S. PATENT DOCUMENTS

| | | | |
|---|---|---|---|
| 1,869,590 | A | 8/1932 | Voss |
| 3,245,235 | A | 4/1966 | Long |
| 3,641,791 | A | 2/1972 | Wine |
| 4,193,275 | A | 3/1980 | Bochan |
| 5,473,915 | A | 12/1995 | Hur et al. |
| 5,675,996 | A | 10/1997 | Cho |
| 6,481,248 | B2 | 11/2002 | Willis |
| 10,787,761 | B2 | 9/2020 | Czarnecki |
| 11,519,122 | B2 | 12/2022 | Kern |
| 11,585,032 | B2 | 2/2023 | Masters |

(Continued)

FOREIGN PATENT DOCUMENTS

| | | | |
|---|---|---|---|
| BR | 102012001746 | A2 | 9/2013 |
| CN | 201500526 | U | 6/2010 |

(Continued)

OTHER PUBLICATIONS

Whirlpool, Top Load Washer with 2 in 1 Removable Agitator, Retrieved from: https://www.whirlpool.com/laundry/washers/top-load/p.5.2-5.3-cu.-ft.-top-load-washer-with-2-in-1-removable-agitator.wtw8127lc.html, Retrieved on Oct. 25, 2021.

(Continued)

*Primary Examiner* — Joseph L. Perrin
(74) *Attorney, Agent, or Firm* — Gray Ice Higdon

(57) ABSTRACT

A laundry washing machine includes a removable agitator that removably couples to an impeller base through a rock-in coupling that allows for relative movement between an agitator coupler of the removable agitator and a base coupler of the impeller base about a fulcrum that is radially offset from the axis of rotation of the impeller base.

20 Claims, 14 Drawing Sheets

(56) References Cited

U.S. PATENT DOCUMENTS

| | | | | |
|---|---|---|---|---|
| 2004/0016267 | A1* | 1/2004 | Clark | D06F 13/02 68/133 |
| 2019/0017208 | A1* | 1/2019 | Marangoni | D06F 37/16 |
| 2019/0062978 | A1* | 2/2019 | Czarnecki | D06F 17/10 |
| 2021/0062382 | A1 | 3/2021 | Andrejczuk | |
| 2022/0235512 | A1 | 7/2022 | Bixby | |
| 2022/0243379 | A1 | 8/2022 | Adkins | |
| 2022/0259784 | A1 | 8/2022 | Hershler et al. | |
| 2022/0275554 | A1 | 9/2022 | Patel | |
| 2022/0290351 | A1 | 9/2022 | Davis | |
| 2022/0290352 | A1 | 9/2022 | Roetker | |
| 2022/0290357 | A1 | 9/2022 | Bhavsar | |
| 2022/0298702 | A1* | 9/2022 | Kern | D06F 23/04 |
| 2022/0298703 | A1 | 9/2022 | Kern | |
| 2022/0298704 | A1 | 9/2022 | Pollett | |
| 2022/0298705 | A1* | 9/2022 | Ford | D06F 13/04 |
| 2022/0316126 | A1 | 10/2022 | Bhavsar | |
| 2022/0325458 | A1 | 10/2022 | Roetker | |
| 2022/0325462 | A1 | 10/2022 | Seereddy et al. | |
| 2022/0380960 | A1* | 12/2022 | Davis | D06F 37/24 |
| 2022/0403579 | A1 | 12/2022 | Anburaj | |
| 2022/0403580 | A1 | 12/2022 | Sreevidhas | |
| 2022/0411982 | A1 | 12/2022 | Czarnecki | |
| 2023/0002949 | A1 | 1/2023 | Rangu | |
| 2023/0011849 | A1 | 1/2023 | Davis | |
| 2023/0026944 | A1 | 1/2023 | Shinde | |
| 2023/0123507 | A1 | 4/2023 | Roetker | |
| 2023/0313434 | A1* | 10/2023 | Lee | B01F 27/114 |
| 2024/0183094 | A1* | 6/2024 | Andrejczuk | D06F 37/20 |
| 2025/0003134 | A1 | 1/2025 | Snook | |
| 2025/0116052 | A1* | 4/2025 | Attar | D06F 17/10 |
| 2025/0198066 | A1* | 6/2025 | Afajalpurkar | D06F 17/10 |

FOREIGN PATENT DOCUMENTS

| | | | |
|---|---|---|---|
| CN | 203395039 | U | 1/2014 |
| CN | 203530690 | U | 4/2014 |
| CN | 113201895 | A | 8/2021 |
| CN | 114606704 | A | 6/2022 |
| CN | 114808396 | A | 7/2022 |
| CN | 115012173 | A | 9/2022 |
| GB | 2308604 | A | 7/1997 |

OTHER PUBLICATIONS

Related Applications Transmittal dated Mar. 19, 2024.

Perrin, Joseph L., United States Patent and Trademark Office, Non-Final Office Action issued in U.S. Appl. No. 18/227,052, 35 pages, dated Jul. 15, 2025.

International Searching Authority, International Search Report and Written Opinion issued in Application No. PCT/CN2024/099600, 15 pages, dated Oct. 24, 2024.

* cited by examiner

LAUNDRY WASHING MACHINE WITH REMOVABLE AGITATOR

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. Nonetheless, the wash tubs of conventional laundry washing machine designs are generally of a single configuration, regardless of the types of loads being washed. Top-load washing machines, for example, often include an agitator that projects upwardly from the bottom of the wash tub and rotates about a vertical axis to agitate the load and/or the wash fluid in the wash tub to enhance washing performance. With some types of loads, however, the agitator is of less value, and in some instances, can make it more difficult to load and/or unload the washing machine. Bulky items such as blankets, comforters, and other bed linens, for example, do not benefit from the use of an agitator, and in many instances can be difficult to load and unload due to the presence of a body that projects upwardly in the center of the wash tub.

A need therefore exists in the art for a manner of customizing the physical configuration of a wash tub of a laundry washing machines to adapt to different types of loads.

SUMMARY

The invention addresses these and other problems associated with the art by providing a laundry washing machine and various types of removable agitators therefor. In some instances, for example, a removable agitator removably couples to an impeller base through a rock-in coupling that allows for relative movement between an agitator coupler of the removable agitator and a base coupler of the impeller base about a fulcrum that is radially offset from the axis of rotation of the impeller base.

Therefore, consistent with one aspect of the invention, a laundry washing machine may include a housing, a wash tub disposed within the housing, an impeller base disposed within the wash tub and configured to rotate about an axis of rotation, the impeller base including a base coupler defining a fulcrum disposed on one side of the axis of rotation, and a catch mechanism defined on an opposite side of the axis of rotation from the fulcrum, and a removable agitator including an agitator coupler configured to removably couple with the base coupler by rocking about the fulcrum defined on the base coupler to orient the removable agitator in a coupled position relative to the impeller base. The agitator coupler may include a release button coupled to the removable agitator and movable within a track along a release axis between depressed and extended positions, and a spring coupled between the removable agitator and the release button to bias the release button to the extended position. The catch mechanism defines a catch aperture sized and configured such that the release button projects through the catch aperture when the removable agitator is in the coupled position and the release button is in the extended position, the catch aperture is further sized and configured to engage the release button when the removable agitator is in the coupled position and the release button is in the extended position to restrict movement of the removable agitator away from the coupled position, and the catch aperture is further sized and configured to disengage from the release button when the release button is in the depressed position to allow for movement of the removable agitator away from the coupled position.

In some embodiments, the catch aperture is formed on an outer wall of the base coupler and the release button projects outwardly from the outer wall of the base coupler when the removable agitator is in the coupled position and the release button is in the extended position.

Also, in some embodiments, the release axis is substantially perpendicular to the axis of rotation when the removable agitator is in the coupled position and the release button is in the extended position. Further, in some embodiments, the catch mechanism and the release button include respective deflection surfaces positioned to engage and deflect the release button towards the depressed position as the removable agitator is rocked into the coupled position.

In some embodiments, the release button includes an upwardly-facing retaining surface that engages an upper edge of the catch aperture when the removable agitator is in the coupled position and the release button is in the extended position to restrict movement of the removable agitator away from the coupled position. In addition, in some embodiments, the base coupler includes a substantially planar support surface configured to engage with a bottom surface of the agitator coupler to support the removable agitator on the impeller base. In some embodiments, the substantially planar support surface is substantially perpendicular the axis of rotation, and in some embodiments, the substantially planar support surface fully circumscribes the axis of rotation.

Moreover, in some embodiments, the fulcrum is defined on an inwardly-projecting ledge of the base coupler, and the agitator coupler includes an outwardly-facing groove configured to receive the inwardly-projecting ledge of the base coupler to support the removable agitator on the impeller base as the removable agitator is rocked into the coupled position. In some embodiments, the inwardly-projecting ledge and the outwardly-facing groove have respective mating surfaces sized and configured to align the agitator coupler with the base coupler as the removable agitator is rocked into the coupled position.

Moreover, in some embodiments, the agitator coupler further includes a downwardly-projecting protrusion defining at least a portion of the outwardly-facing groove, and the downwardly-projecting protrusion includes an outer edge that is radially offset further from, and is at a lower elevation along, the axis of rotation than an inner edge of the inwardly-projecting ledge when the removable agitator is in the coupled position such that the inwardly-projecting ledge of the base coupler and the downwardly-projecting leg of the agitator coupler restrict axial movement of the removable agitator when the removable agitator is in the coupled position.

In some embodiments, the catch mechanism is disposed at a higher elevation along the axis of rotation than the fulcrum. In addition, in some embodiments, the track includes a pair of slots on opposite sides thereof and extending substantially parallel to the release axis, and the release button includes a pair of oppositely-facing pins respectively received in the pair of slots to constrain movement of the release button along the release axis.

Some embodiments may also include a cap including a cap coupler configured to removably couple with the base coupler when the removable agitator is separated from the impeller base by rocking about the fulcrum defined on the base coupler to orient the cap in a coupled position relative to the impeller base.

Moreover, in some embodiments, the track is a first track, the release axis is a first release axis, the spring is a first spring, and the cap coupler includes a second release button coupled to the cap and movable within a second track along a second release axis between depressed and extended positions, and a second spring coupled between the cap and the second release button to bias the second release button to the extended position, where the first and second release buttons are sized and configured substantially similar to one another such that the second release button projects through the catch aperture when the cap is in the coupled position and the second release button is in the extended position and thereby restricts movement of the cap away from the coupled position.

Also, in some embodiments, the removable agitator includes a storage coupler disposed at an opposite end from the agitator coupler and configured to store the cap on the removable agitator. In some embodiments, the storage coupler is sized and configured similar to the base coupler such that the cap secures to the storage coupler and the base coupler in substantially the same manner. In addition, in some embodiments, the storage coupler includes a substantially cylindrical storage reservoir sized and configured to receive the cap without engaging the second release button thereof.

Consistent with another aspect of the invention, a laundry washing machine may include a housing, a wash tub disposed within the housing, an impeller base disposed within the wash tub and configured to rotate about an axis of rotation, the impeller base including a base coupler defining a fulcrum disposed on one side of the axis of rotation, and a catch mechanism defined on an opposite side of the axis of rotation from the fulcrum, and a removable agitator including an agitator coupler configured to removably couple with the base coupler by rocking about the fulcrum defined on the base coupler to orient the removable agitator in a coupled position relative to the impeller base. The agitator coupler includes a release button movable within a track along a release axis between depressed and extended positions and biased to the extended position, the release button configured to engage the catch mechanism when the removable agitator is in the coupled position and the release button is in the extended position, and the catch mechanism is disposed at a higher elevation along the axis of rotation than the fulcrum.

Also, in some embodiments, the base coupler includes a substantially planar support surface configured to engage with a bottom surface of the agitator coupler to support the removable agitator on the impeller base, and the substantially planar support surface fully circumscribes the axis of rotation and is substantially perpendicular the axis of rotation.

Consistent with another aspect of the invention, a laundry washing machine may include a housing, a wash tub disposed within the housing, an impeller base disposed within the wash tub and configured to rotate about an axis of rotation, the impeller base including a base coupler, and a removable agitator including an agitator coupler configured to removably couple with the base coupler to thereby removably secure the removable agitator to the impeller base, and the base coupler may include a hinged member configured to circumscribe at least a portion of the agitator coupler and to rotate about a pivot axis that is radially offset from, and substantially parallel to, the axis of rotation when the removable agitator is in a coupled position to restrict movement of the removable agitator away from the coupled position.

Consistent with another aspect of the invention, a laundry washing machine may include a housing, a wash tub disposed within the housing, an impeller base disposed within the wash tub and configured to rotate about an axis of rotation, the impeller base including a base coupler, and a removable agitator including an agitator coupler configured to removably couple with the base coupler to thereby removably secure the removable agitator to the impeller base, and the base couple may include a pin configured to extend radially through an aperture of the base coupler and a sleeve of the agitator coupler when the removable agitator is in a coupled position to restrict movement of the removable agitator away from the coupled position.

Consistent with another aspect of the invention, a laundry washing machine may include a housing, a wash tub disposed within the housing, an impeller base disposed within the wash tub and configured to rotate about an axis of rotation, the impeller base including a base coupler, and a removable agitator including an agitator coupler configured to removably couple with the base coupler to thereby removably secure the removable agitator to the impeller base. The base coupler includes a first set of threads and the agitator coupler includes a second set of threads configured to threadably engage the first set of threads when the removable agitator is in a coupled position to restrict movement of the removable agitator away from the coupled position, and the agitator coupler further includes a rotatable shaft coupled to the second set of threads and configured to rotate about the axis of rotation, the rotatable shaft extending through an internal channel of the removable agitator, and an externally accessible rotatable cap disposed proximate an opposite end of the removable agitator from the base coupler when the removable agitator is in the coupled position and operably coupled to rotate the rotatable shaft and thereby threadably engage or disengage the first and second sets of threads.

Consistent with another aspect of the invention, a laundry washing machine may include a housing, a wash tub disposed within the housing, an impeller base disposed within the wash tub and configured to rotate about an axis of rotation, and a removable agitator including a unitary body including an agitator portion and an impeller base cover, the removable agitator sized and covered to cover at least a portion of the impeller base when the removable agitator is removably secured to the removable agitator to the impeller base.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Embodiments consistent with the invention may be used to adapt the physical configuration of a wash tub of a laundry washing machine through selective use of a rock-in removable agitator that in some embodiments is secured to an impeller base by rocking about a fulcrum. Additional embodiments of various alternate coupling mechanisms are also discussed hereinafter.

Figure 1:
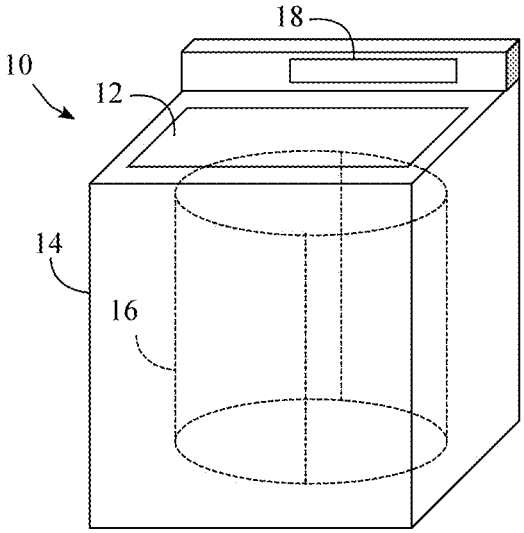
FIG. 1 is a perspective view of a top-load laundry washing machine consistent with some embodiments of the invention.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
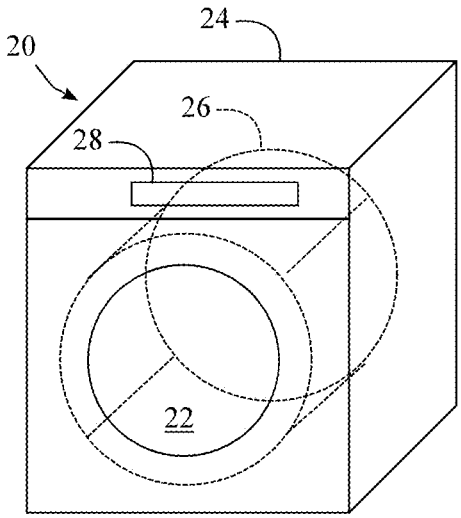
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
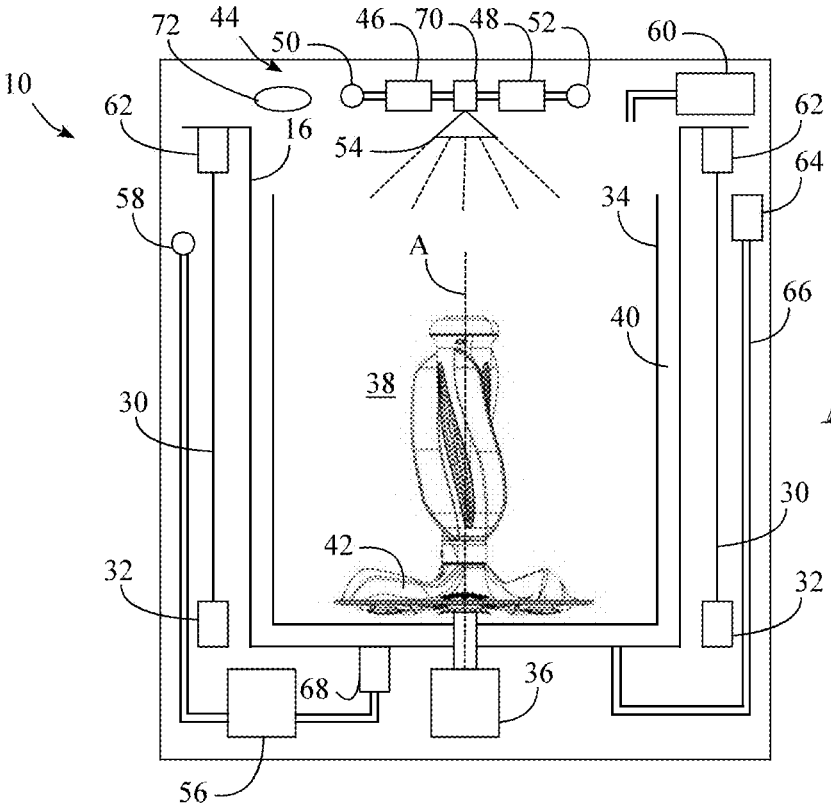
FIG. 3 is a functional vertical section of the laundry washing machine of FIG. 1.
Figure 4:
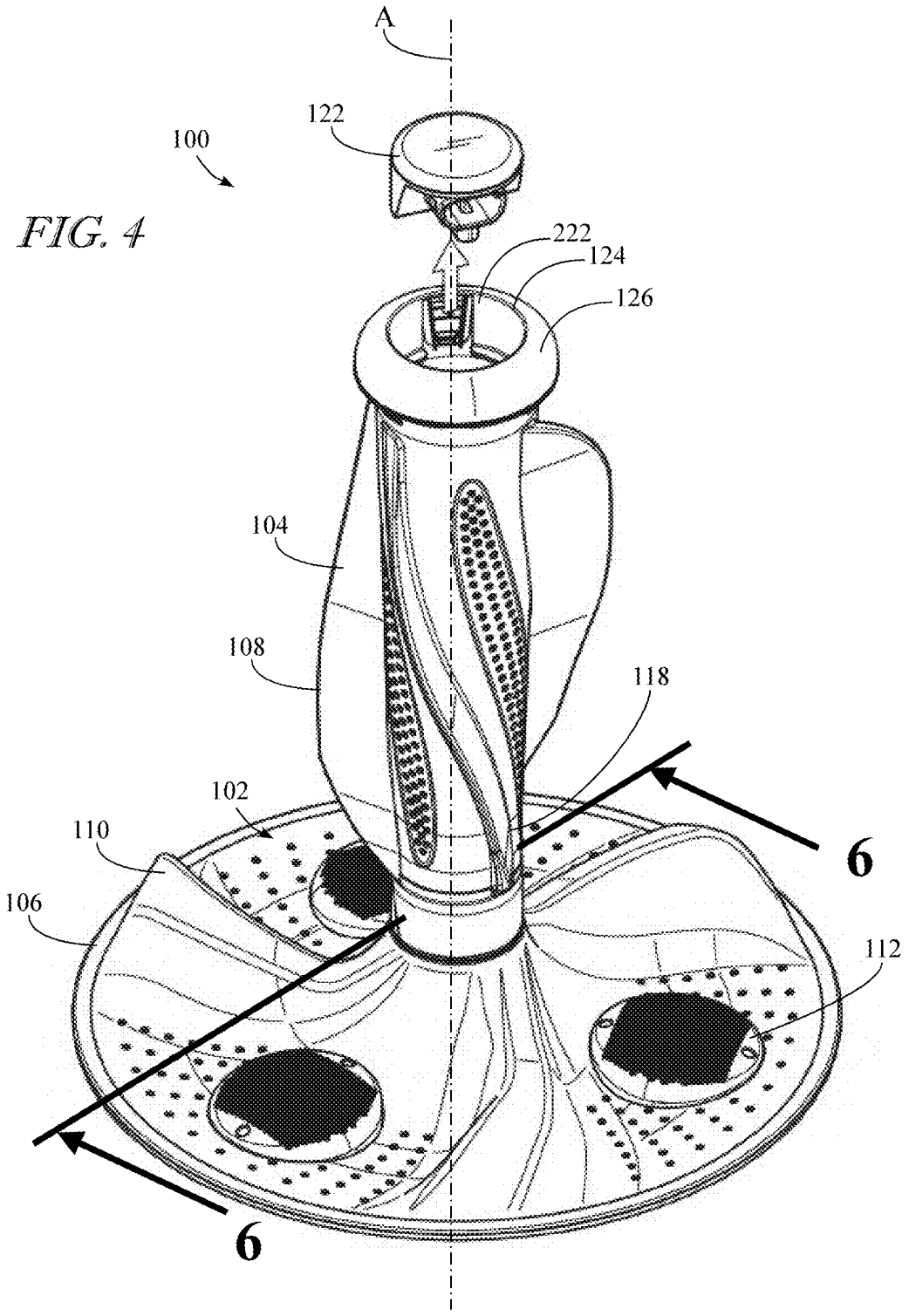
FIG. 4 is a perspective view of one example embodiment of the load agitation assembly of FIG. 3, illustrating the removable agitator coupled to the impeller base and the cap separated therefrom.

FIG. 3 functionally illustrates a number of components in laundry washing machine 10. Wash tub 16 is vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, a load agitation assembly 42 may be disposed in the interior 38 of wash basket 34 to agitate items within wash basket 34 during a washing operation. Load agitation assembly 42 may be driven by drive system 36, e.g., for rotation about the same axis as wash basket 34, and a transmission and/or clutch within drive system 36 may be used to selectively rotate load agitation assembly 42. In other embodiments, separate drive systems may be used to rotate wash basket 34 and load agitation assembly 42. As will become more apparent below, load agitation assembly 42 may include a removable agitator or post that is supported by an impeller base to enable wash cycles to be performed using either an agitator configuration or an impeller configuration.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Load Agitation Assembly with Rock-In Removable Agitator

As noted above, in some embodiments a load agitation assembly may be provided with a removable agitator, thereby enabling a laundry washing machine to operate in multiple configurations. In a first, agitator configuration, a removable agitator or post is attached to an impeller base, such that the laundry washing machine operates in a similar manner to a laundry washing machine that includes a fixed agitator, while in a second, impeller configuration, the removable agitator is removed from the impeller base, such that the laundry washing machine operates in a similar manner to a laundry washing machine that lacks a fixed agitator, and instead relies solely on an impeller to agitate a load. The latter configuration may be better suited, for example, for large or bulky loads including as blankets, comforters, and other bed linens, although both types of configurations have other benefits and better suitability for different types of loads.

Various manners of removably coupling a removable agitator to an impeller base have been proposed, with many focusing primarily on attachment via some form of axial movement along the axis of rotation of the load agitation assembly (e.g., vertical movement in the case of a top-load washing machine). In some embodiments consistent with the invention, however, a rock-in coupling may be used to removably couple a removable agitator to an impeller base. In this regard, a rock-in coupling may be considered to be a coupling where movement of the removable agitator relative to the impeller base during attachment and removal of the removable agitator is implemented in part through a rocking movement about a fulcrum that is radially offset from the axis of rotation of the load agitation assembly.

Figure 6:
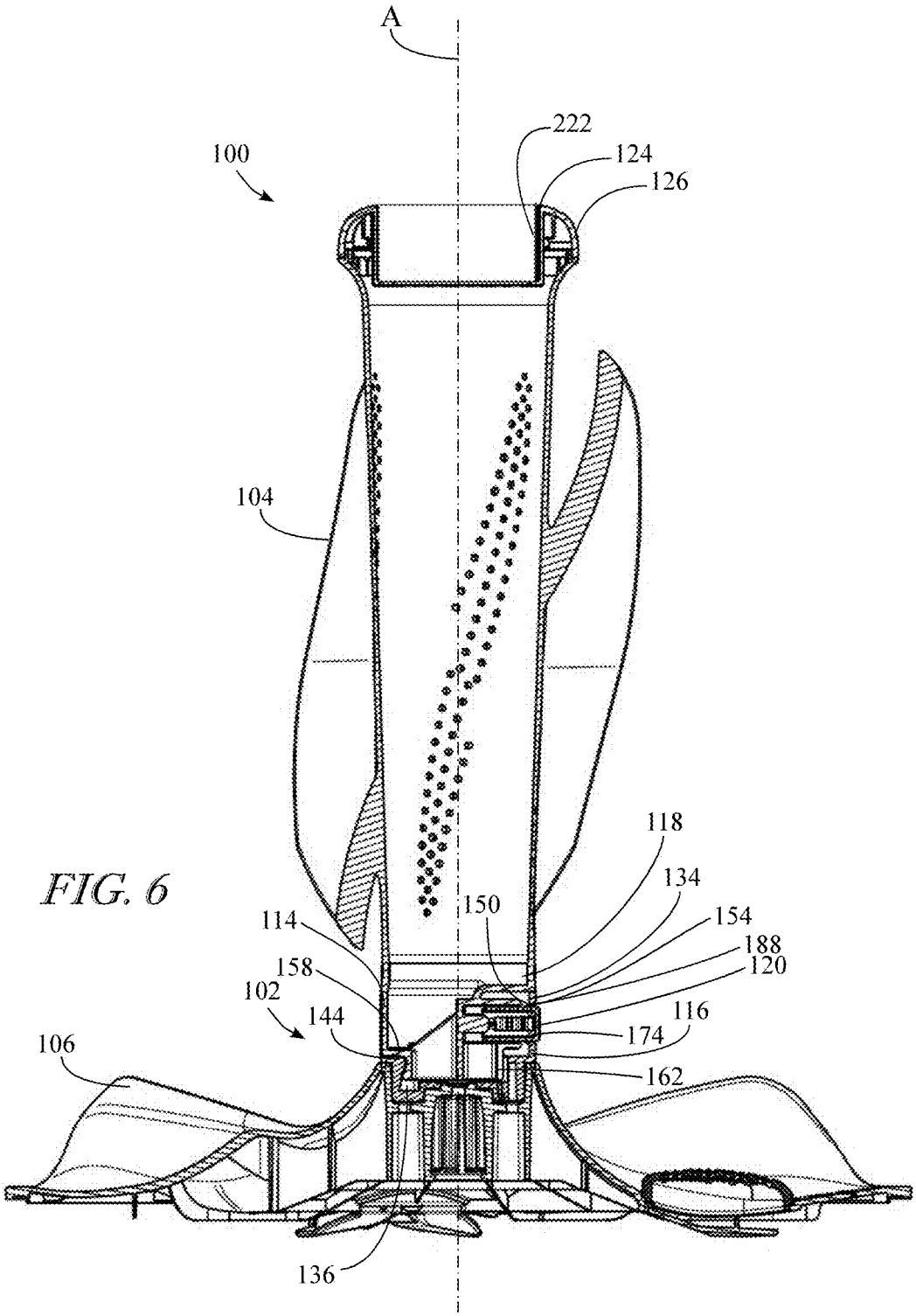
FIG. 6 is a cross-sectional view taken through lines 6-6 of FIG. 4.
Figure 7:
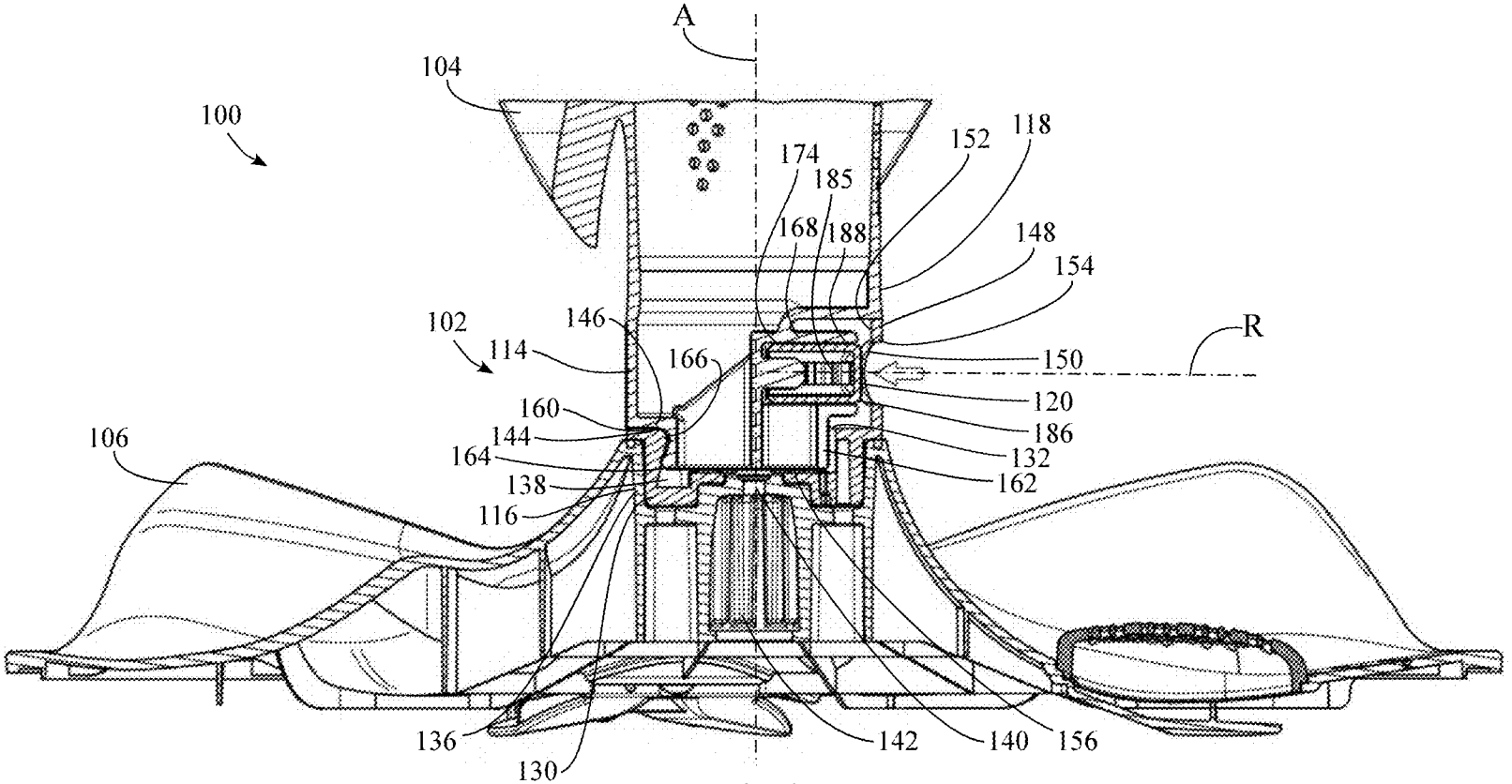
FIG. 7 is an enlarged cross-sectional view similar to FIG. 6, after depression of the release actuator.
Figure 8:
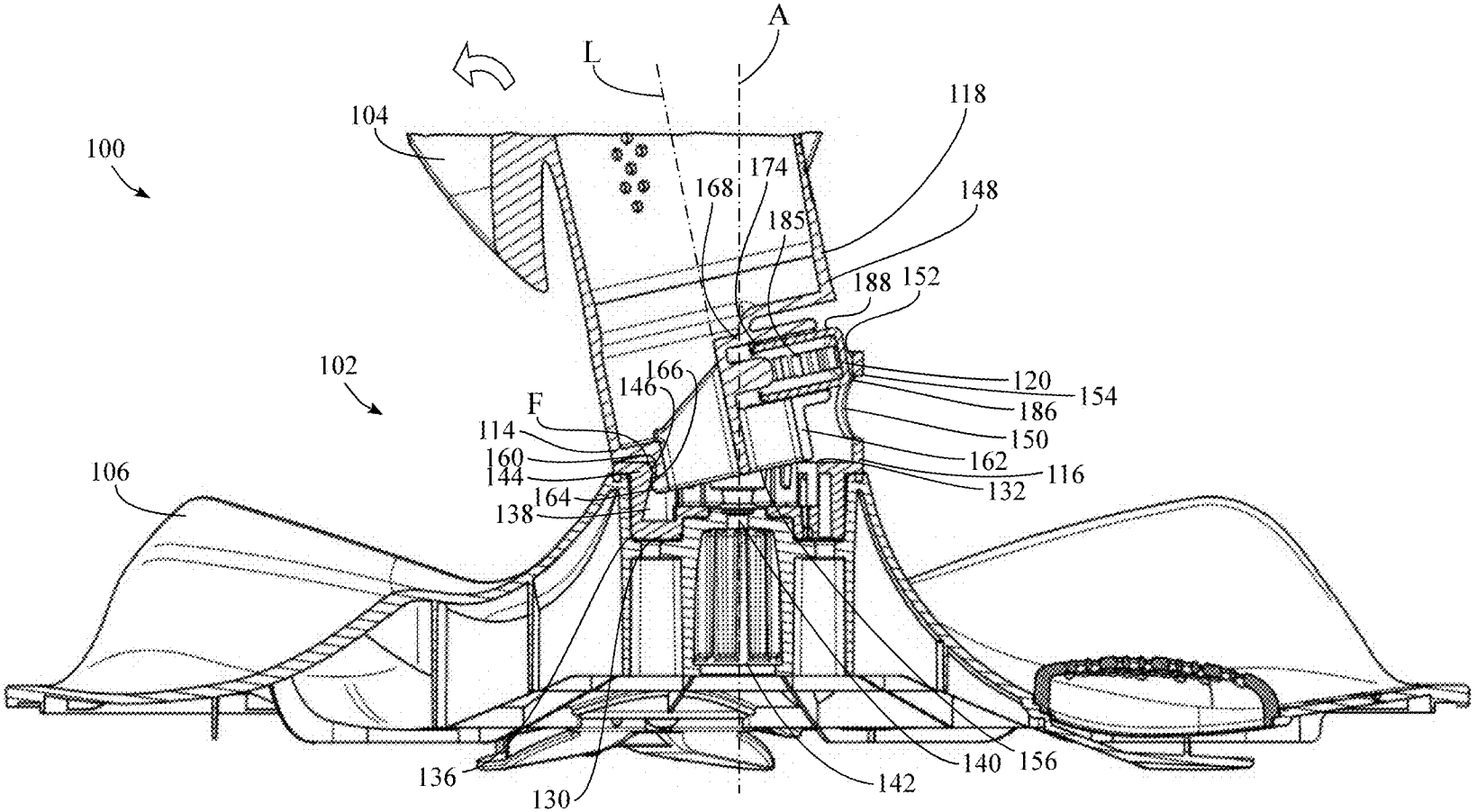
FIG. 8 is an enlarged cross-sectional view similar to FIG. 7, after rocking the removable agitator away from a coupled position.

FIGS. 4-15, for example, illustrate one embodiment of a load agitation assembly 100 in which a rock-in coupling 102 between a removable agitator 104 and an impeller base 106 includes rocking movement about a fulcrum F that is radially offset from the axis of rotation A of load agitation assembly 100 (see, e.g., FIG. 8). Load agitation assembly 100 may include various components for agitating a load when rotated, including, for example, one or more vanes or fins 108 disposed on removable agitator 104, one or more vanes or fins 110 disposed on impeller base 106, and/or one or more scooping members 112 that circulate wash fluid within the wash tub. Various agitator and/or impeller designs may be used in different embodiments, as will be appreciated by those of ordinary skill having the benefit of the instant disclosure.

Figure 5:
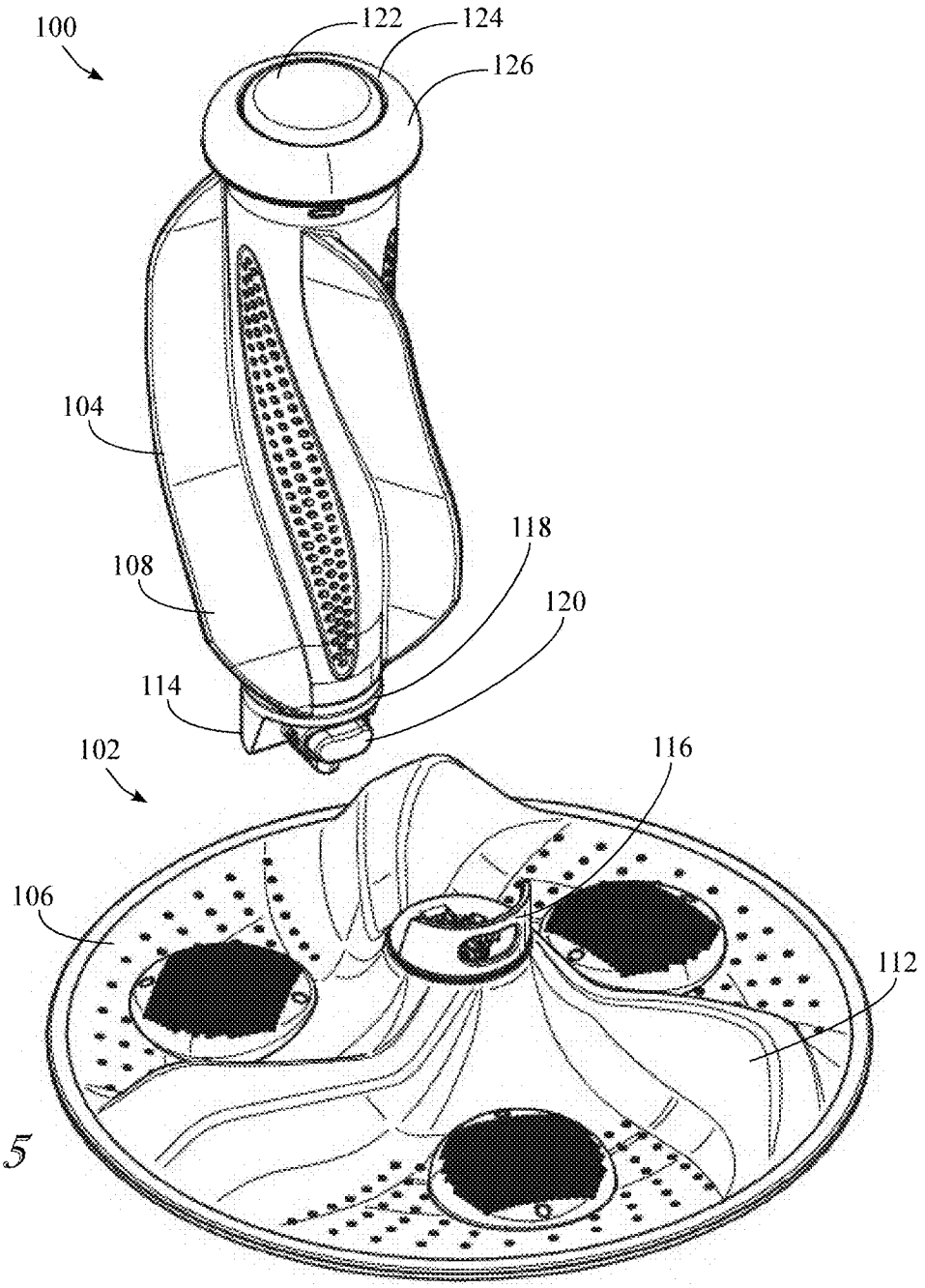
FIG. 5 is a perspective view of the load agitation assembly of FIG. 4, illustrating the removable agitator separated from the impeller base, and with the cap stored in the removable agitator.
Figure 9:
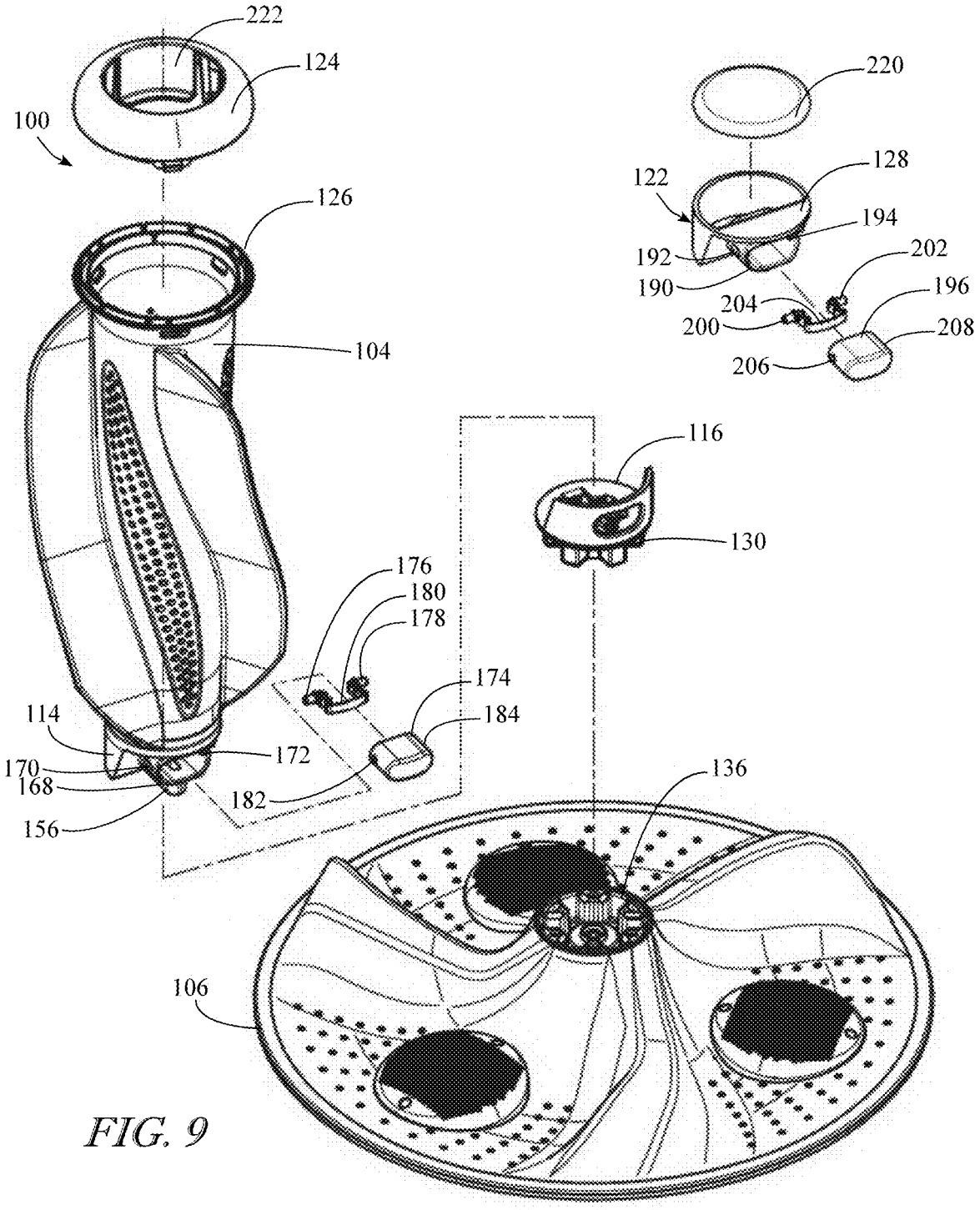
FIG. 9 is an exploded perspective view of the load agitation assembly of FIG. 4.

With reference to FIGS. 5 and 9, rock-in coupling 102, in the illustrated embodiment, includes an agitator coupler 114 and a base coupler 116, with the agitator coupler disposed proximate a first end 118 of removable agitator 104 and the base coupler disposed at the top of impeller base 106. In some embodiments, portions of agitator coupler 114 may be integrally formed onto removable agitator 104 while base coupler 116 may be a separate component that is mounted to impeller base 106, although the invention is not so limited. In addition, a release actuator 120, e.g., a release button, is disposed on removable agitator 104 to allow for relative movement between removable agitator 104 and impeller base 106 about the fulcrum to remove the removable agitator from the impeller base.

Figure 11:
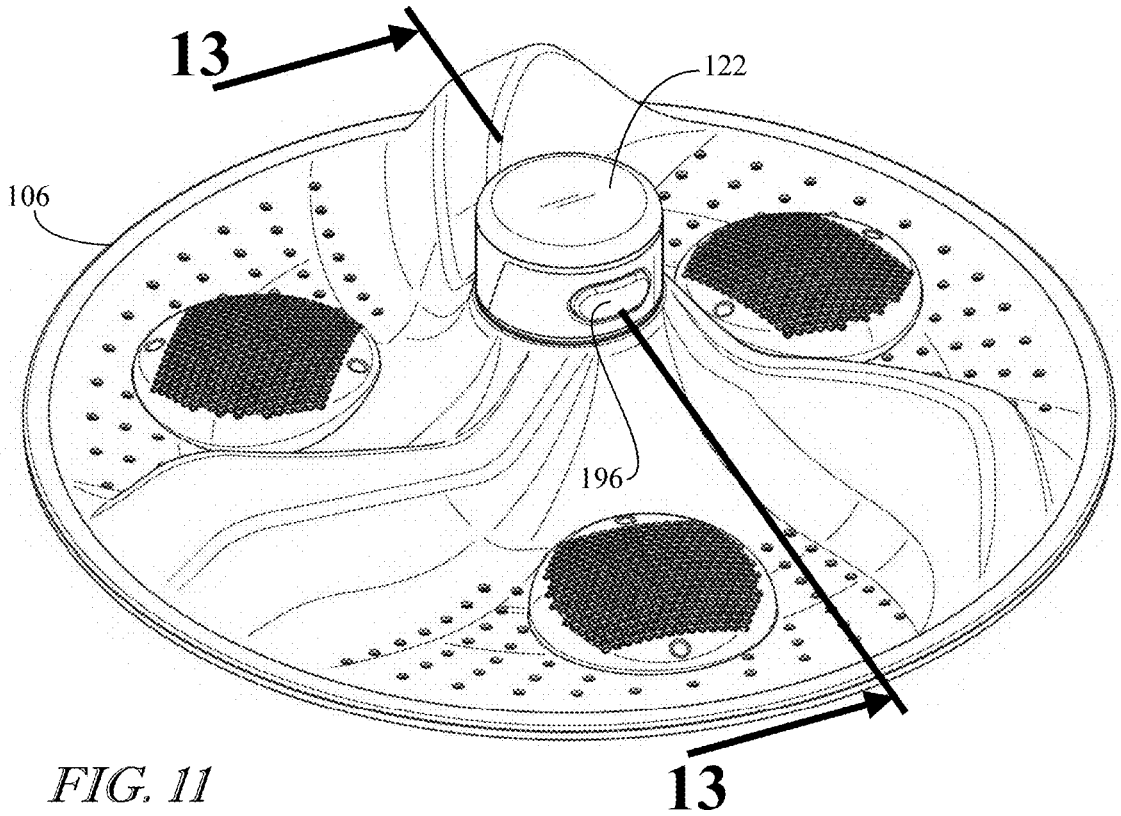
FIG. 11 is a perspective view of the load agitation assembly of FIG. 4, illustrating the cap coupled to the impeller base.

In addition, in some embodiments, it may also be desirable to provide a cap 122 that may be secured to base coupler 116 of impeller base 106 when removable agitator 104 has been removed (as illustrated in FIG. 11). Further, in some embodiments, it may also be desirable to provide a storage coupler 124 proximate a second end 126 of removable agitator 104 opposite first end 118 to allow cap 122 to be stored on removable agitator 104 (as illustrated in FIG. 5). As will become more apparent below, cap 122 includes a cap coupler 128 that is configured similarly to agitator coupler 114, and base coupler 116 and storage coupler 124 are similarly configured such that cap 122 may be secured in a similar manner to each of base coupler 116 and storage coupler 124.

Figure 10:
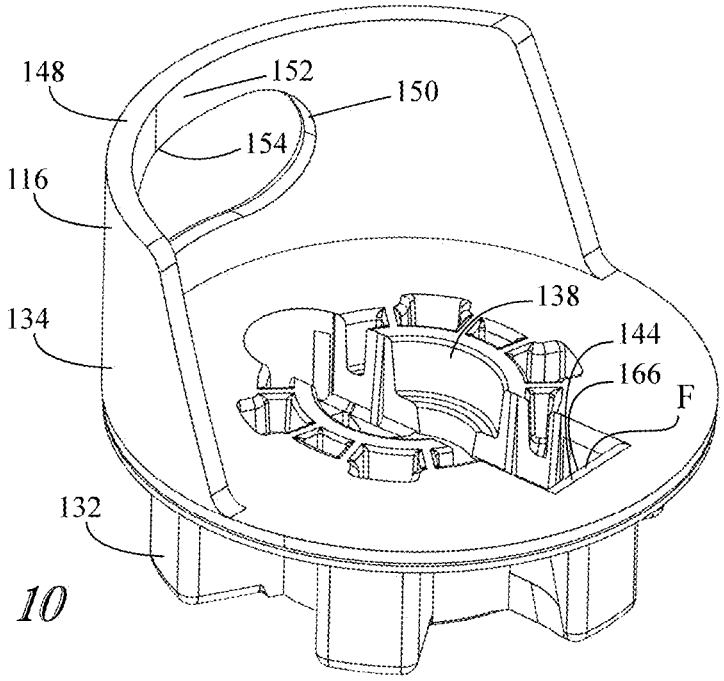
FIG. 10 is a perspective view the base coupler of FIG. 9.

With additional reference to FIG. 10, base coupler 116 includes a keyed mount 130, a support surface 132 and a collar 134. Keyed mount 130 is configured restrict rotation of base coupler 116 relative to impeller base 106 when mounted in a receptacle 136 in base coupler 116, and a channel 138 projects downwardly from support surface 132 to receive a bolt 140 that both secures base coupler 116 and impeller base 106 to one another and secures impeller base 106 to a drive spindle 142 that drives rotation of the impeller base (FIG. 7). As will be discussed in further detail below, fulcrum F is defined on an inwardly-projecting ledge 144 that includes a mating surface 146.

Collar 134 extends upwardly from support surface 132 at least a portion of the way around axis of rotation A, and when removable agitator 104 is secured to impeller base 106, effectively forms a portion of an outer wall of removable agitator 104. A catch mechanism 148 is defined on collar 134, and includes a catch aperture 150 and a deflection surface 152, with an upper edge 154 of catch aperture 150 being operative to engage release actuator 120 to restrict movement of removable agitator 104 away from a coupled position when mounted to impeller base 106. Catch mechanism 148 it should be noted is defined on an opposite side of axis of rotation A from inwardly-projecting ledge 144 and thus, from fulcrum F.

With reference to FIGS. 6-9 (FIG. 11 may also be referenced due to the similar configuration of cap coupler 128), agitator coupler 114 includes a bottom surface 156 that is configured to be supported by support surface 132 when removable agitator 104 is in a coupled position and secured to impeller base 106 (FIG. 6). In the illustrated embodiment, each of support surface 132 and bottom surface 156 is substantially planar and is substantially perpendicular to axis of rotation A. In addition, support surface 132 fully circumscribes the axis of rotation (FIG. 10), such that the load of removable agitator 104 on impeller base 106 is borne across a relatively large percentage of the cross-sectional area of base coupler 116, which can be beneficial in applications where a rock-in coupling is used and a collar that fully circumscribes the removable agitator 104 may not be feasible.

Agitator coupler 114 also includes an outwardly-facing groove 158 having a mating surface 160 that is configured to mate with mating surface 146 of base coupler 116 when removable agitator 104 is in a coupled position and secured to impeller base 106, such that inwardly-projecting ledge 144 is received in outwardly-facing groove 158 as removable agitator 104 is rocked into a coupled position and secured to impeller base 106. In some embodiments, mating surfaces 160 and 146 may be sized and configured to align agitator coupler 114 with base coupler 116 as removable agitator 104 is rocked into a coupled position with impeller base 106 about fulcrum F. In addition, in some embodiments, at least a portion of outwardly-facing groove 158 is defined on a downwardly-projecting protrusion 162 that is sized and configured to be received in channel 136 to form a mortise and tenon joint that restricts relative rotation between removable agitator 104 and impeller base 106, as well as further assists with alignment of agitator coupler 114 with base coupler 116 as removable agitator 104 is rocked into a coupled position with impeller base 106. In addition, with reference to FIGS. 6 and 7, downwardly-projecting protrusion 162 includes an outer edge 164 that is radially offset further from, and is at a lower elevation along, the axis of rotation A than an inner edge 166 of inwardly-projecting ledge 144 such that inwardly-projecting ledge 144 of base coupler 116 and downwardly-projecting protrusion 162 of agitator coupler 114 restrict axial movement of removable agitator 104 away from impeller base 106 when removable agitator 104 is in the coupled position.

With reference to FIG. 9 (FIG. 11 may also be referenced due to the similar configuration of cap coupler 128), agitator coupler 114 may define a track 168 configured to receive release actuator or button 120. A pair of opposing slots 170, 172 may be defined on opposing sides of track 168, and track 168 is sized and configured to receive a button body 174 of release actuator 120 and allow for movement of the button body along a release axis R. In the illustrated embodiment, release axis R is substantially perpendicular to axis of rotation A, although the invention is not so limited. Slots 170, 172 extend substantially parallel to release axis R, and a pair of opposing pins 176, 178 are mounted to button body 174 and are received in slots 170, 172 to constrain movement of button body 174 along the release axis R between an extended position (as shown in FIG. 6) and a depressed position (as shown in FIG. 7). While other constructions may be used, in the illustrated embodiment, pins 176, 178 are formed on a resilient member 180 and are received in a pair of apertures 182, 184 in button body 174, which enables pins 176, 178 to be depressed inwardly when installing button body 174 within track 168. A biasing member such as a compression spring 185 (see FIGS. 6-8) is also disposed within track 168 and effectively coupled between removable agitator 104 and button body 174 to bias button body 174 to the extended position.

Button body 174 also includes a deflection surface 186 that is configured to engage with the corresponding deflection surface 152 on catch mechanism 148 as removable agitator 104 is being rocked into the coupled position, as well as an upwardly-facing retaining surface 188 that engages upper edge 154 of catch aperture 150 to restrict movement of the removable agitator away from the coupled position.

Specifically, as illustrated in FIG. 6, when removable agitator 104 is in the coupled position and release actuator or button 120 is in an extended position, button body 174 projects outwardly from the outer wall defined by collar 134, and upwardly-facing retaining surface 188 engages upper edge 154 of catch aperture 150. At the same time, downwardly-projecting protrusion 162 is received in channel 136 and inwardly-projecting ledge 144 is received in outwardly-facing groove 158 such that axial movement of removable agitator 104 away from impeller base 106 is restricted. In addition, by virtue of these various interconnections, relative rotation between removable agitator 104 and impeller base 106 is also restricted. It will be appreciated that in other embodiments, button body 174 may be flush with, or even recessed inwardly from, the outer wall defined by collar 134.

Separation of removable agitator 104 from impeller base 106 is illustrated in FIGS. 7-8. As shown in FIG. 7, for example, button body 174 may be depressed (pushed inwardly) along release axis R, and thereby move from an extended position to a released position, such that upwardly-facing retaining surface 188 disengages from upper edge 154 of catch aperture 150. Then, as illustrated in FIG. 8, removable agitator 104 may be rocked away from the coupled position about fulcrum F, and in some instances, mating surfaces 146, 160 may slide relative to one another as removable agitator 104 is rocked away. In addition, once button body 174 has cleared catch aperture 150 and released, deflection surface 186 of button body 174 may slide along deflection surface 152 of catch mechanism 148 until button body 174 returns to the extended position. At this point, removable agitator 104 may be lifted upwardly and out of engagement with impeller base 106, whereby removable agitator 104 is separated from impeller base 106.

Mounting of removable agitator 104 to impeller base 106 is performed in a reverse manner, by initially setting removable agitator 104 on impeller base 106 with inwardly-projecting ledge 144 of base coupler 116 received in outwardly-facing groove 158 of agitator coupler 114 and removable agitator 104 tilted at an angle away from the coupled position (e.g., where a longitudinal axis L of the removable agitator is offset from and angled away from axis of rotation A). Then, removable agitator 104 may be rocked toward the coupled position, and as illustrated in FIG. 8, deflection surfaces 152, 186 may engage one another and deflect button body 174 inwardly from the extended position to the depressed position, until button body 174 aligns with catch aperture 150, whereby deflection surfaces 152, 186 disengage from one another, and the bias of spring 185 automatically extends button body 174 to the extended position, whereby upwardly-facing retaining surface 188 engages upper edge 154 of catch aperture 150 to restrict movement of removable agitator 104 away from the coupled position, thereby locking removable agitator 104 into the coupled position.

It will be appreciated that, in the illustrated embodiment, catch aperture 150 is sized and configured relative to button body 174 such that button body 174 projects through catch aperture 150 when removable agitator 104 is in the coupled position and button body 174 is in the extended position. In addition, the catch aperture is sized and configured to engage button body 174 when the removable agitator is in the coupled position and the button body is in the extended position to restrict movement of the removable agitator away from the coupled position, as well as to disengage from button body 174 when the release button is in the depressed position to allow for movement of the removable agitator away from the coupled position.

In addition, it will be appreciated that catch mechanism 148, as well as release actuator or button 120, is disposed at a higher elevation along the axis of rotation A than fulcrum F. By doing so, access to release actuator 120 by a user is facilitated, as it will be appreciated that a user will generally have to reach down into the wash tub in order to reach the release actuator. In addition, this arrangement, along with the arrangements of outwardly-facing groove 158 and inwardly-projecting ledge 144 and of downwardly-projecting protrusion 162 and channel 136, facilitates proper placement and alignment of removable agitator 104 when rocking into the coupled position, thereby simplifying installation of the removable agitator.

Figure 12:
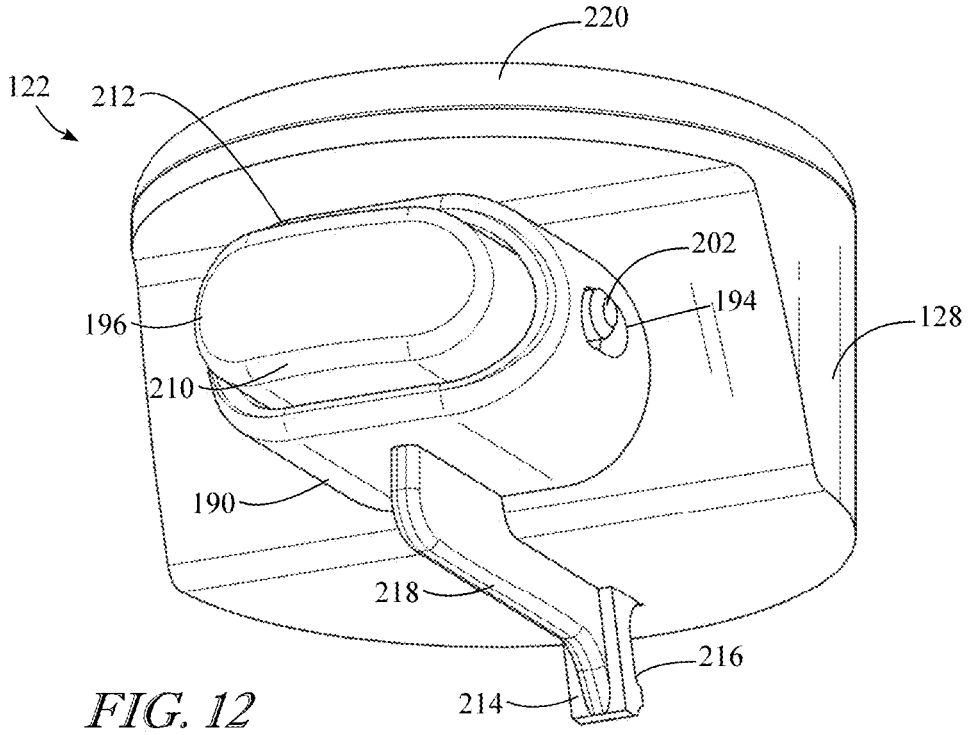
FIG. 12 is a perspective view the cap of the load agitation assembly of FIG. 4.
Figure 13:
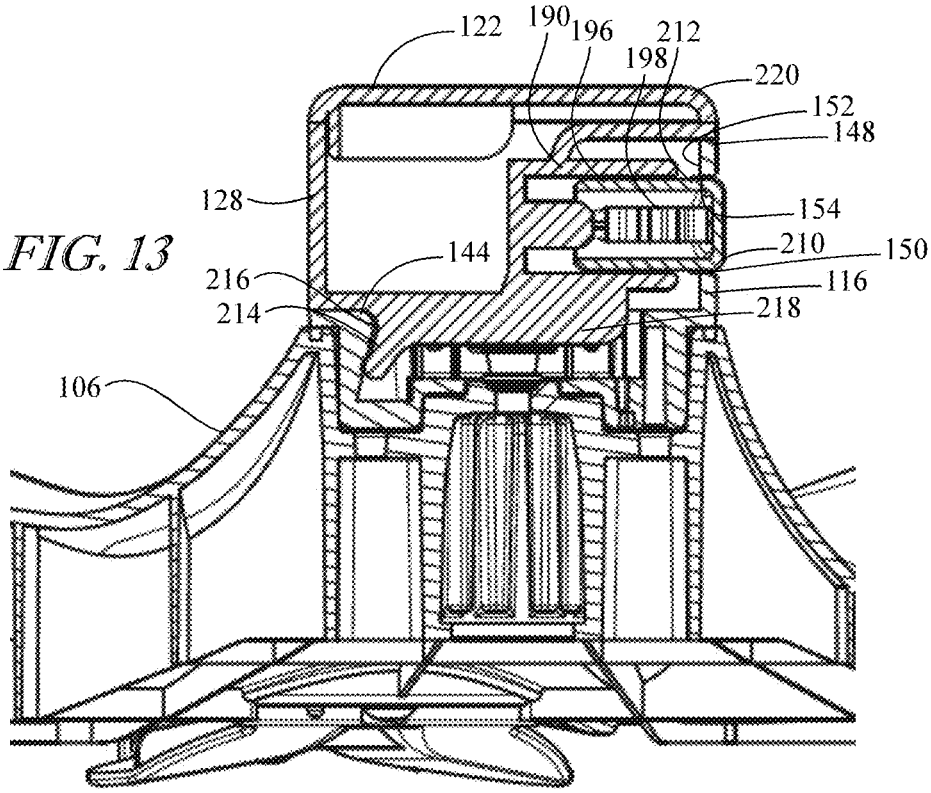
FIG. 13 is a cross-sectional view taken through lines 13-13 of FIG. 11.

Now turning to FIG. 12, and with additional reference to FIGS. 9 and 13, as noted above cap coupler 128 of cap 122 may be similarly configured to agitator coupler 114 of removable agitator 104, and may define a track 190 having a pair of opposing slots 192, 194 and sized and configured to receive a button body 196, as well as a spring 198 that biases the button body to an extended position. A pair of opposing pins 200, 202 joined by a resilient member 204 are received in a pair of apertures 206, 208 in button body 196, such that when pins 200, 202 are depressed inwardly, button body 196 may be pressed into track 190 until pins 200, 202 align with slots 192, 194, whereby the pins extend into the slots and constrain movement of button body 196 to movement between extended and depressed positions. Of note, button body 196 is sized and configured in a similar manner to button body 174, such that button body 196 has a deflection surface 210 and upwardly-facing retaining surface 212 similar to the corresponding surfaces 186, 188 on button body 196.

Cap coupler 128 also includes a downwardly-projecting leg 214 upon which is defined an outwardly-facing groove 216 similar to outwardly-facing groove 158 of agitator coupler 114. A support rib 218, positioned to be received in channel 136 of base coupler 116, may also be provided to strengthen downwardly-projecting leg 214.

Figure 14:
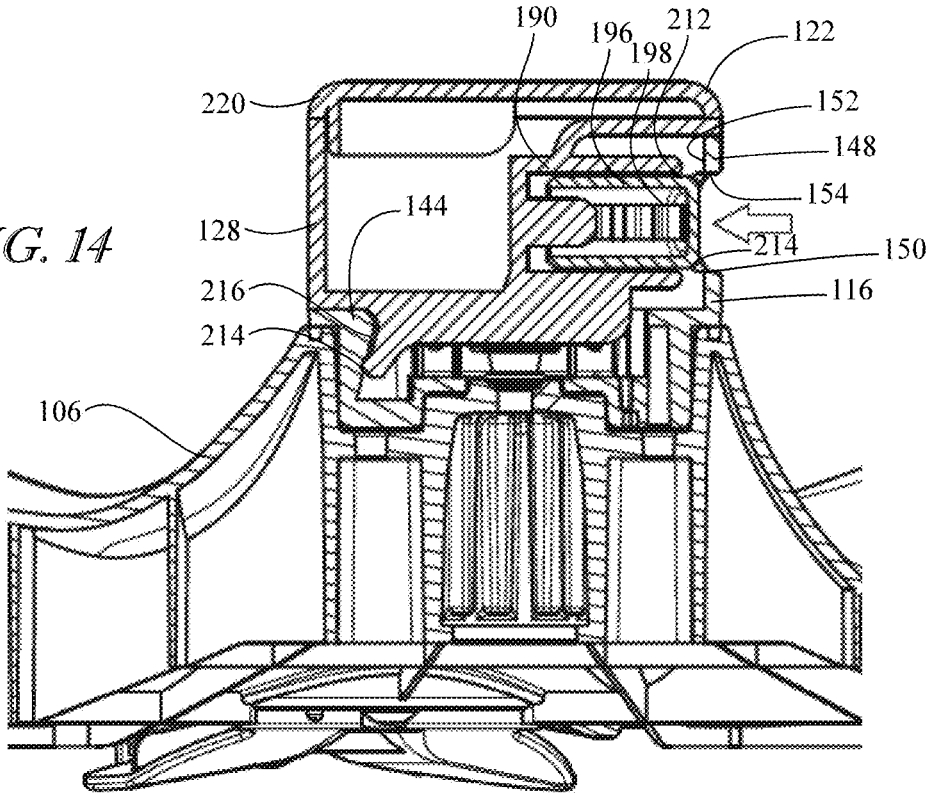
FIG. 14 is an enlarged cross-sectional view similar to FIG. 13, after depression of the release actuator.
Figure 15:
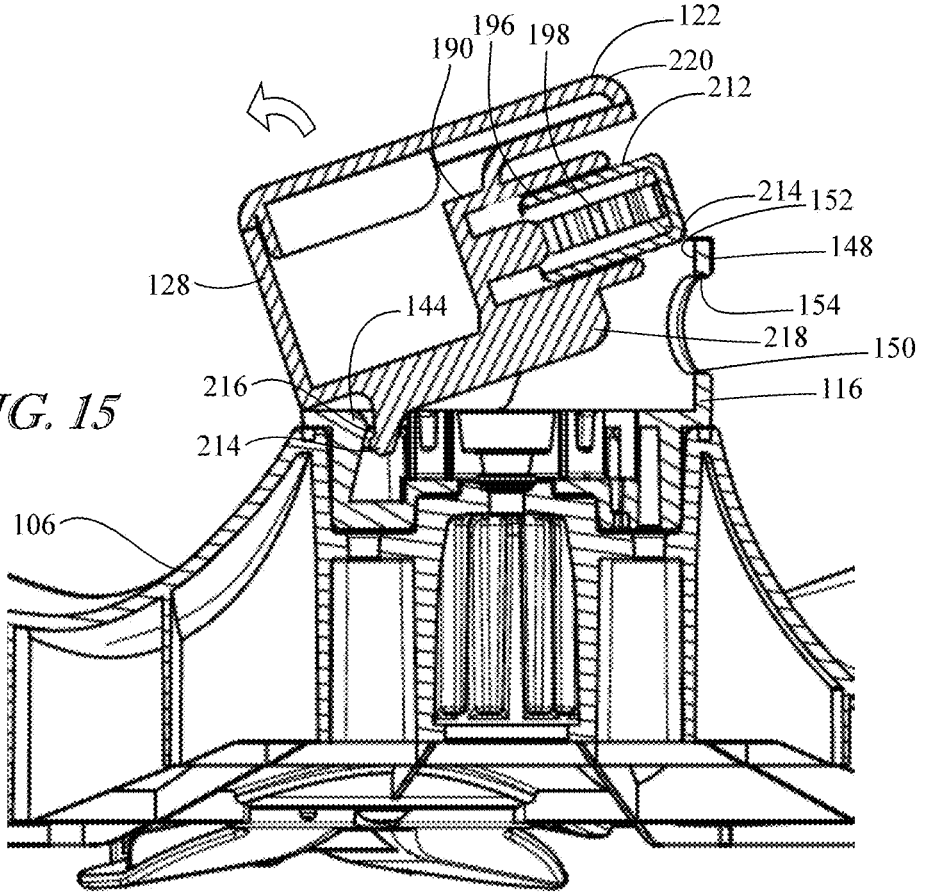
FIG. 15 is an enlarged cross-sectional view similar to FIG. 13, after rocking the cap away from a coupled position.

Separation of cap 122 from impeller base 106 once mounted on impeller base 106 and in a coupled position is illustrated in FIGS. 14-15. As shown in FIG. 14, for example, button body 196 may be depressed (pushed inwardly), and thereby move from an extended position to a released position, such that upwardly-facing retaining surface 212 disengages from upper edge 154 of catch aperture 150. Then, as illustrated in FIG. 15, cap 122 may be rocked away from the coupled position, and once button body 196 has cleared catch aperture 150 and released, deflection surface 210 of button body 196 may slide along deflection surface 152 of catch mechanism 148 until button body 196 returns to the extended position. At this point, cap 122 may be lifted upwardly and out of engagement with impeller base 106.

Mounting of cap 122 to impeller base 106 is performed in a reverse manner, by initially setting cap 122 on impeller base 106 with inwardly-projecting ledge 144 of base coupler 116 received in outwardly-facing groove 216 of cap coupler 128 and cap 122 tilted at an angle away from the coupled position. Then, cap 122 104 may be rocked toward the coupled position, and deflection surfaces 152, 210 may engage one another and deflect button body 196 inwardly from the extended position to the depressed position, until button body 196 aligns with catch aperture 150, whereby deflection surfaces 152, 210 disengage from one another, and the bias of spring 198 automatically extends button body 196 to the extended position, whereby upwardly-facing retaining surface 212 engages upper edge 154 of catch aperture 150 to restrict movement of cap 122 away from the coupled position, thereby locking cap 122 into the coupled position.

Returning to FIGS. 4, 5, and 9, cap 122 may also include a cap cover 220, and when not in use, cap 122 may be stored in or on removable agitator 104 using storage coupler 124. While in some embodiments storage coupler 124 may be similarly configured as base coupler 116, such that attachment and removal of cap 122 to and from storage coupler 124 is performed in a similar manner to that performed with base coupler 116, in the illustrated embodiment, storage coupler 124 is defined by a substantially cylindrical storage reservoir 222 that houses the cap without engagement through a similar engagement as described above for base coupler 116. It will be appreciated that cap 122 may merely be inserted into and removed from reservoir 222, and in some instances, resilient tabs or detents may be used to maintain the cap in place in the reservoir. Other manners of storing cap 122 in or on removable agitator 104 may be used in other embodiments.

Removable Agitator with Collar Coupling Mechanism

Figure 16:
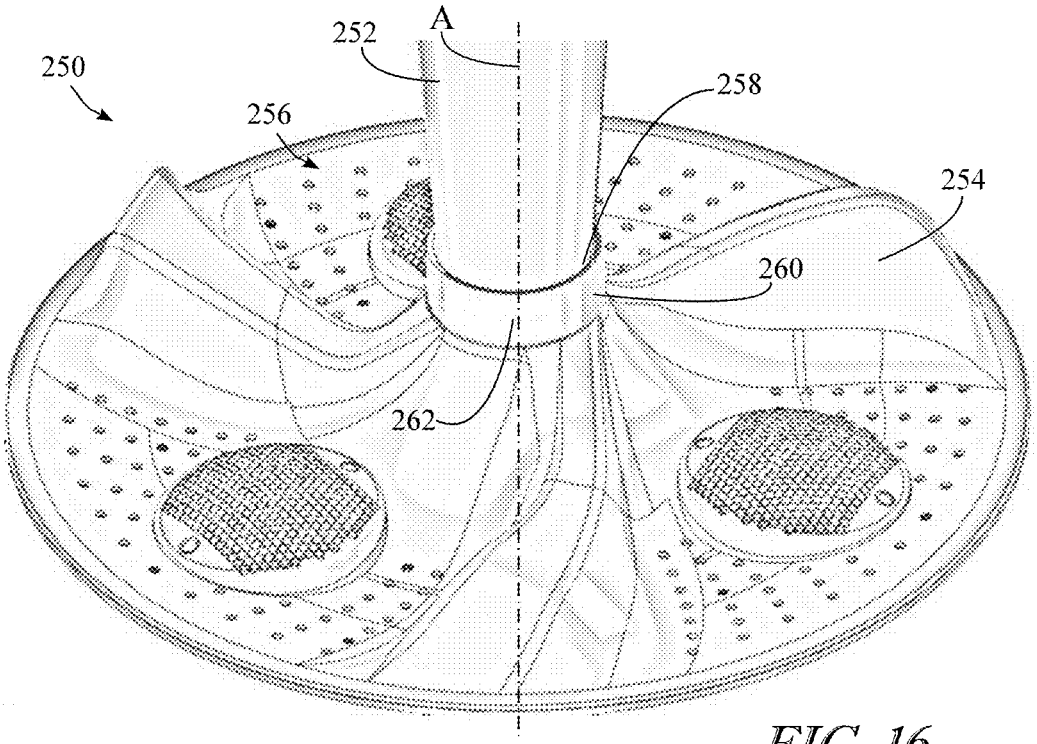
FIG. 16 is a perspective view of another example embodiment of a load agitation assembly consistent with the invention, and including a collar coupling mechanism in a secured position.
Figure 17:
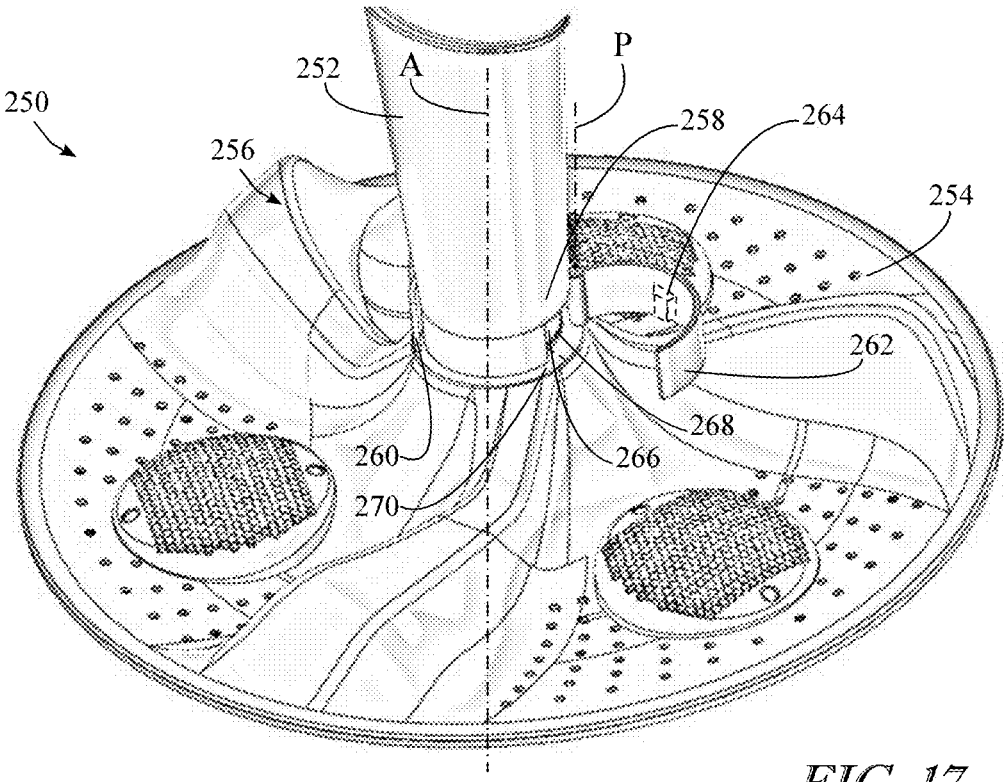
FIG. 17 is a perspective view of the load agitation assembly of FIG. 16, illustrating the collar coupling mechanism in a released position.

In another embodiment, and as illustrated in FIGS. 16-17, a load agitation assembly 250 may include a removable agitator 252 that is removably secured to an impeller base 254 with a collar coupling arrangement 256. In particular, an agitator coupler 258 may be configured to be received in a base coupler 260, e.g., using a keyed arrangement that restricts rotation of the removable agitator relative to the impeller base, and a hinged member 262 that circumscribes at least a portion of agitator coupler 258 may be configured to rotate about a pivot axis P that is radially offset from, and substantially parallel to, axis of rotation A when removable agitator 252 is in a coupled position to restrict movement of the removable agitator away from the coupled position.

FIG. 16 illustrates hinged member 262 in a secured position that restricts movement of the removable agitator away from the coupled position, while FIG. 17 illustrates hinged member 262 in a released position that allows for movement of the removable agitator away from the coupled position. Various manners of restricting movement of the removable agitator may be used in different embodiments. For example, in some embodiments, a structure such as body 264 may be coupled to hinged member 262 and configured to project towards the axis of rotation when hinged member 262 is in the secured position. Body 264 may project into a recess 266 in agitator coupler 258 and engage with a surface 268 thereof to restrict movement of the removable agitator away from the coupled position.

In other embodiments, however, other arrangements may be used. For example, in some embodiments, the hinged member itself may restrict movement of the removable agitator away from the coupled position, e.g., where a portion of surface 270 is formed as part of the agitator coupler, such that hinged member 262 restricts upward movement of the portion when in a secured position. As another example, a hinged member in some embodiments may function as a lever of a circumferential clamp and apply a compressive force around the circumference of the agitator coupler. In addition, it may be desirable to provide a separate cap for covering the base coupler when the removable agitator is separated from the impeller base. Other arrangements will be apparent to those of ordinary skill having the benefit of the instant disclosure.

Removable Agitator With Pin Coupling Mechanism

Figure 18:
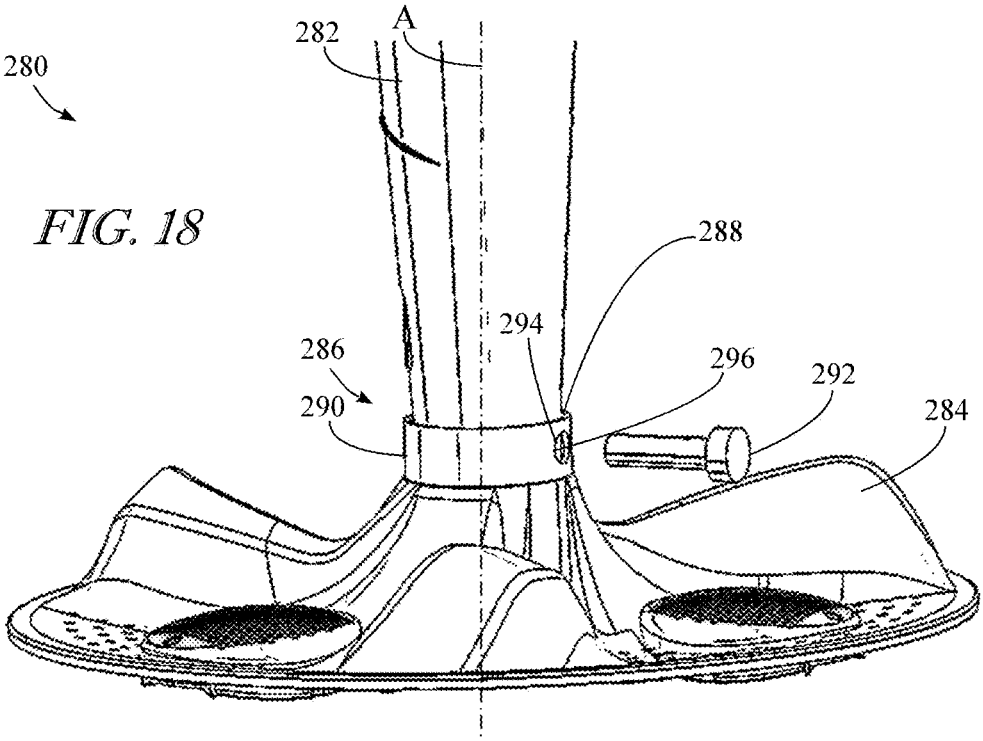
FIG. 18 is a perspective view of another example embodiment of a load agitation assembly consistent with the invention, and including a pin coupling mechanism in a secured position.
Figure 19:
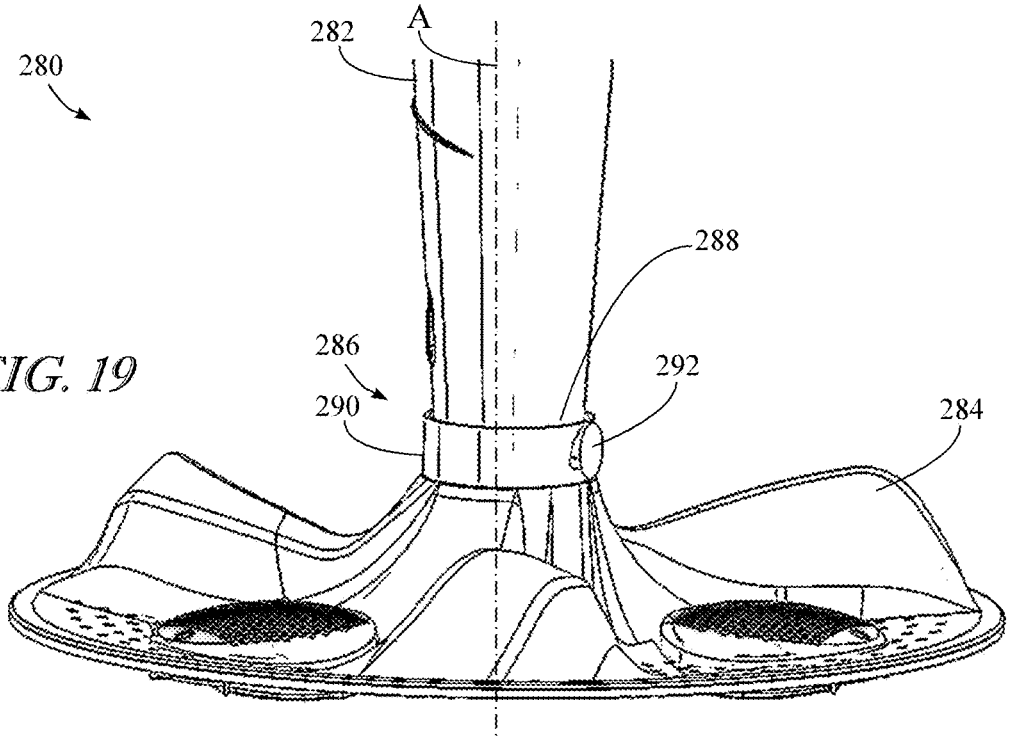
FIG. 19 is a perspective view of the load agitation assembly of FIG. 18, illustrating the pin coupling mechanism in a released position.

In another embodiment, and as illustrated in FIGS. 18-19, a load agitation assembly 280 may include a removable agitator 282 that is removably secured to an impeller base 284 with a pin coupling arrangement 286. In particular, an agitator coupler 288 may be configured to be received in a base coupler 290, e.g., using a keyed arrangement that restricts rotation of the removable agitator relative to the impeller base, and a pin 292 that extends radially towards the axis of rotation A may be insertable into an aperture 294 in base coupler 290 and into a sleeve 296 in agitator coupler 288 to restrict movement of the removable agitator away from the coupled position.

FIG. 18 illustrates pin 292 in a released position that allows for movement of the removable agitator away from the coupled position, while FIG. 19 illustrates pin 292 inserted into aperture 294 and sleeve 296 to restrict movement of the removable agitator away from the coupled position. Various alternative designs may also be incorporated into the illustrated embodiment, including, for example, a storage sleeve in removable agitator 282 and/or impeller base 284 that is configured to receive pin 292 when removable agitator 282 is separated from impeller base 284. In addition, other pin designs may be used, e.g., including various handle configurations that facilitate removal of the pin and/or various locking configurations that minimize unintentional removal of the pin. In addition, it may be desirable to provide a separate cap for covering the base coupler when the removable agitator is separated from the impeller base. Other arrangements will be apparent to those of ordinary skill having the benefit of the instant disclosure.

Removable Agitator with Internally Threaded Coupling Mechanism

Figure 20:
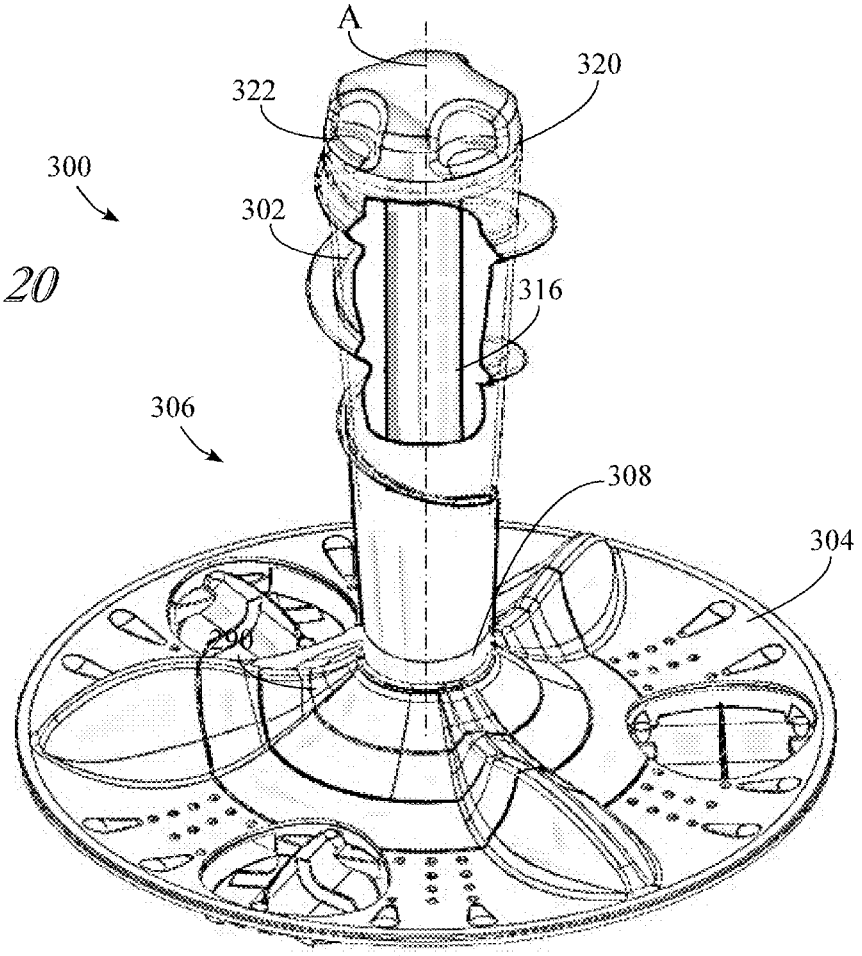
FIG. 20 is a perspective view of another example embodiment of a load agitation assembly consistent with the invention, with portions cut away to illustrate shaft of an internal threaded coupling mechanism thereof.
Figure 21:
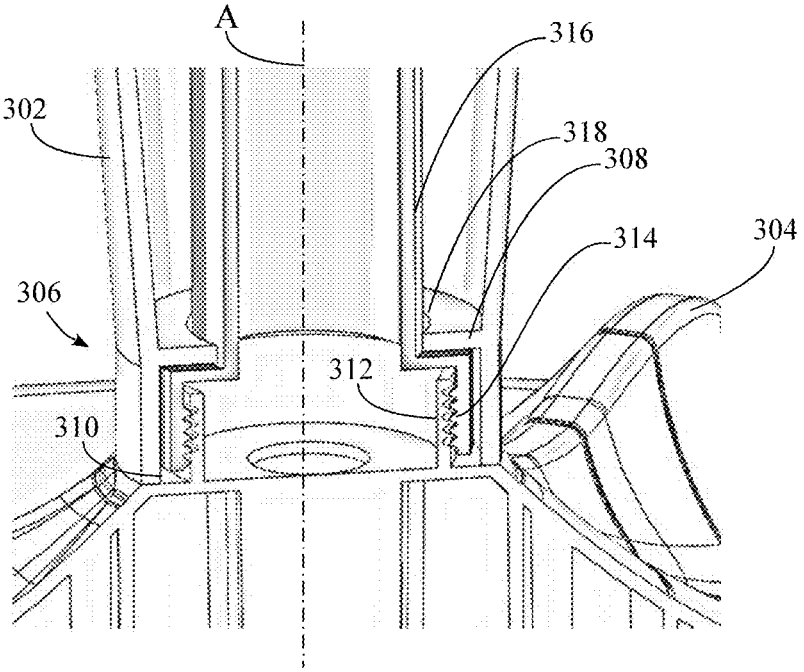
FIG. 21 is an enlarged cross-sectional view of the load agitation assembly of FIG. 20.

In another embodiment, and as illustrated in FIGS. 20-21, a load agitation assembly 300 may include a removable agitator 302 that is removably secured to an impeller base 304 with an internally threaded coupling mechanism 306. In particular, an agitator coupler 308 may be configured to be received in a base coupler 310, e.g., using a keyed arrangement that restricts rotation of the removable agitator relative to the impeller base, and a threaded coupling arrangement may be formed between one set of threads 312 coupled to base coupler 310 and another set of threads 314 coupled to agitator coupler 308 and generally rotatable about axis of rotation A. In this embodiment, threads 314 are disposed on a rotatable shaft 316 that is rotatably supported in an internal channel 318 of removable agitator 302 and coupled to a rotatable cap 320 disposed proximate a top of removable agitator 302, and opposite base coupler 310 when removable agitator 302 is in a coupled position. Cap 320 may also include one or more depressions 322 configured to facilitate user rotation of the cap, and thus the shaft 316 and threads 314.

It will be appreciated that in the illustrated embodiment, cap 320 effectively defines a top of removable agitator 302. However, in other embodiments, other rotatable actuators, e.g., a handle, may be used to rotate rotatable shaft 316, so the invention is not so limited. In addition, it may be desirable to provide a separate cap for covering the base coupler when the removable agitator is separated from the impeller base. Other arrangements will be apparent to those of ordinary skill having the benefit of the instant disclosure.

Unitary Removable Agitator and Impeller Base Cover

Figure 22:
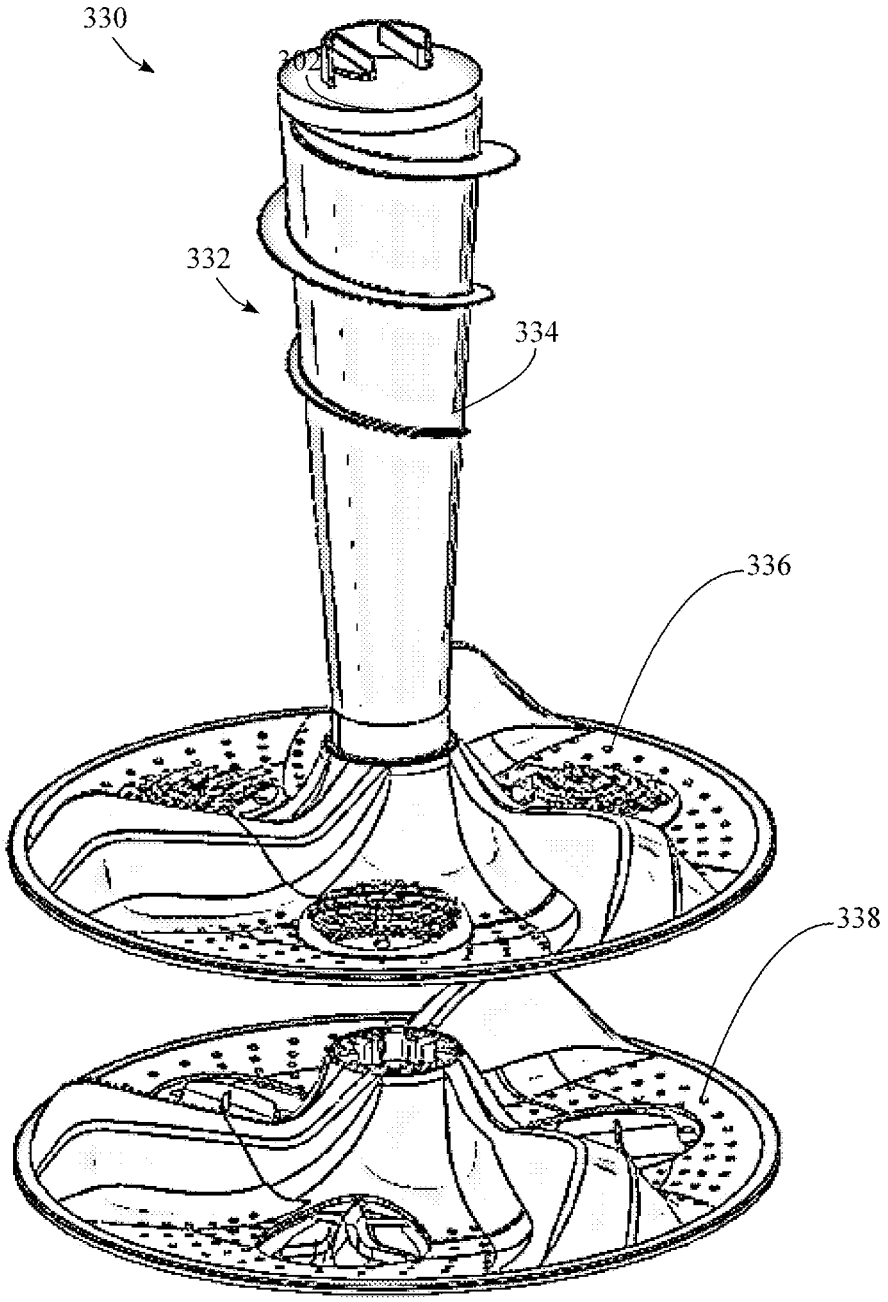
FIG. 22 is a perspective view of another example embodiment of a load agitation assembly consistent with the invention, and including a unitary removable agitator and impeller base cover.

In another embodiment, and as illustrated in FIG. 22, a load agitation assembly 330 may include a removable agitator 332 that is formed as a unitary removable agitator and impeller base cover that includes both an agitator portion 334 and an impeller portion 336 that are integrated (e.g., integrally formed, or otherwise secured together) into a single unitary component. In such an embodiment, impeller portion 336 may be sized and configured to fit on top of an existing impeller base 338 and effectively operate as the impeller base of the load agitation assembly when used. It will be appreciated that bottom surface profile of impeller portion 336 may be configured to match the upper surface profile of impeller base 338 in some embodiments so that the impeller portion functions in a similar manner to impeller base 338. Other profiles may be used, however, so long as removable agitator 332 may be suitably attached to impeller base 338.

In addition, various manners of attaching removable agitator 332 to impeller base 338 may be used, e.g., friction fit, snap fit, quick release fasteners, or other manners of releasably securing an agitator to an impeller base. Other arrangements will be apparent to those of ordinary skill having the benefit of the instant disclosure.

It will also be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A laundry washing machine, comprising:

a housing;

a wash tub disposed within the housing;

an impeller base disposed within the wash tub and configured to rotate about an axis of rotation, the impeller base including a base coupler defining a fulcrum disposed on one side of the axis of rotation, and a catch mechanism defined on an opposite side of the axis of rotation from the fulcrum; and a removable agitator including an agitator coupler configured to removably couple with the base coupler by rocking about the fulcrum defined on the base coupler to orient the removable agitator in a coupled position relative to the impeller base;

wherein the agitator coupler includes:

a release button coupled to the removable agitator and movable within a track along a release axis between depressed and extended positions; and a spring coupled between the removable agitator and the release button to bias the release button to the extended position;

wherein the catch mechanism defines a catch aperture sized and configured such that the release button projects through the catch aperture when the removable agitator is in the coupled position and the release button is in the extended position;

wherein the catch aperture is further sized and configured to engage the release button when the removable agitator is in the coupled position and the release button is in the extended position to restrict movement of the removable agitator away from the coupled position;

wherein the catch aperture is further sized and configured to disengage from the release button when the release button is in the depressed position to allow for movement of the removable agitator away from the coupled position;

wherein the fulcrum is defined on an inwardly-projecting ledge of the base coupler, and wherein the agitator coupler includes an outwardly-facing groove configured to receive the inwardly-projecting ledge of the base coupler to support the removable agitator on the impeller base as the removable agitator is rocked into the coupled position; and wherein the inwardly-projecting ledge and the outwardly-facing groove have respective mating surfaces sized and configured to align the agitator coupler with the base coupler as the removable agitator is rocked into the coupled position.

2. The laundry washing machine of claim 1, wherein the catch aperture is formed on an outer wall of the base coupler and the release button projects outwardly from the outer wall of the base coupler when the removable agitator is in the coupled position and the release button is in the extended position.

3. The laundry washing machine of claim 1, wherein the release axis is substantially perpendicular to the axis of rotation when the removable agitator is in the coupled position and the release button is in the extended position.

4. The laundry washing machine of claim 1, wherein the catch mechanism and the release button include respective deflection surfaces positioned to engage and deflect the release button towards the depressed position as the removable agitator is rocked into the coupled position.

5. The laundry washing machine of claim 1, wherein the release button includes an upwardly-facing retaining surface that engages an upper edge of the catch aperture when the removable agitator is in the coupled position and the release button is in the extended position to restrict movement of the removable agitator away from the coupled position.

6. The laundry washing machine of claim 1, wherein the base coupler includes a substantially planar support surface configured to engage with a bottom surface of the agitator coupler to support the removable agitator on the impeller base.

7. The laundry washing machine of claim 6, wherein the substantially planar support surface is substantially perpendicular the axis of rotation.

8. The laundry washing machine of claim 6, wherein the substantially planar support surface fully circumscribes the axis of rotation.

9. The laundry washing machine of claim 1, wherein the agitator coupler further includes a downwardly-projecting protrusion defining at least a portion of the outwardly-facing groove, wherein the downwardly-projecting protrusion includes an outer edge that is radially offset further from, and is at a lower elevation along, the axis of rotation than an inner edge of the inwardly-projecting ledge when the removable agitator is in the coupled position such that the inwardly-projecting ledge of the base coupler and the downwardly-projecting leg of the agitator coupler restrict axial movement of the removable agitator when the removable agitator is in the coupled position.

10. The laundry washing machine of claim 1, wherein the catch mechanism is disposed at a higher elevation along the axis of rotation than the fulcrum.

11. The laundry washing machine of claim 1, wherein the track includes a pair of slots on opposite sides thereof and extending substantially parallel to the release axis, and the release button includes a pair of oppositely-facing pins respectively received in the pair of slots to constrain movement of the release button along the release axis.

12. The laundry washing machine of claim 1, further comprising a cap including a cap coupler configured to removably couple with the base coupler when the removable agitator is separated from the impeller base by rocking about the fulcrum defined on the base coupler to orient the cap in a coupled position relative to the impeller base.

13. The laundry washing machine of claim 12, wherein the track is a first track, the release axis is a first release axis, the spring is a first spring, and the cap coupler includes:

a second release button coupled to the cap and movable within a second track along a second release axis between depressed and extended positions; and a second spring coupled between the cap and the second release button to bias the second release button to the extended position;

wherein the first and second release buttons are sized and configured substantially similar to one another such that the second release button projects through the catch aperture when the cap is in the coupled position and the second release button is in the extended position and thereby restricts movement of the cap away from the coupled position.

14. The laundry washing machine of claim 12, wherein the removable agitator includes a storage coupler disposed at an opposite end from the agitator coupler and configured to store the cap on the removable agitator.

15. The laundry washing machine of claim 14, wherein the storage coupler is sized and configured similar to the base coupler such that the cap secures to the storage coupler and the base coupler in substantially the same manner.

16. The laundry washing machine of claim 14, wherein the storage coupler comprises a substantially cylindrical storage reservoir sized and configured to receive the cap without engaging the second release button thereof.

17. A laundry washing machine, comprising:

a housing;

a wash tub disposed within the housing;

an impeller base disposed within the wash tub and configured to rotate about an axis of rotation, the impeller base including a base coupler defining a fulcrum disposed on one side of the axis of rotation, and a catch mechanism defined on an opposite side of the axis of rotation from the fulcrum; and a removable agitator including an agitator coupler configured to removably couple with the base coupler by rocking about the fulcrum defined on the base coupler to orient the removable agitator in a coupled position relative to the impeller base;

wherein the agitator coupler includes a release button movable within a track along a release axis between depressed and extended positions and biased to the extended position, the release button configured to engage the catch mechanism when the removable agitator is in the coupled position and the release button is in the extended position; and wherein the base coupler further includes a collar extending partially around the axis of rotation on the opposite side of the axis of rotation from the fulcrum and forming a portion of an outer wall of the removable agitator when the removable agitator is in the coupled position;

wherein the catch mechanism is disposed on the collar and at a higher elevation along the axis of rotation than the fulcrum.

18. The laundry washing machine of claim 17, wherein the base coupler includes a substantially planar support surface configured to engage with a bottom surface of the agitator coupler to support the removable agitator on the impeller base, and the substantially planar support surface fully circumscribes the axis of rotation and is substantially perpendicular the axis of rotation.

19. The laundry washing machine of claim 17, further comprising a cap including a cap coupler configured to removably couple with the base coupler when the removable agitator is separated from the impeller base by rocking about the fulcrum defined on the base coupler to orient the cap in a coupled position relative to the impeller base;

wherein the track is a first track, the release axis is a first release axis, the spring is a first spring, and the cap coupler includes:

a second release button coupled to the cap and movable within a second track along a second release axis between depressed and extended positions; and a second spring coupled between the cap and the second release button to bias the second release button to the extended position; and wherein the first and second release buttons are sized and configured substantially similar to one another such that the second release button projects through the catch aperture when the cap is in the coupled position and the second release button is in the extended position and thereby restricts movement of the cap away from the coupled position.

20. A laundry washing machine, comprising:

a housing;

a wash tub disposed within the housing;

an impeller base disposed within the wash tub and configured to rotate about an axis of rotation, the impeller base including a base coupler defining a fulcrum disposed on one side of the axis of rotation, and a catch mechanism defined on an opposite side of the axis of rotation from the fulcrum; and a removable agitator including an agitator coupler configured to removably couple with the base coupler by rocking about the fulcrum defined on the base coupler to orient the removable agitator in a coupled position relative to the impeller base;

wherein the agitator coupler includes a release button movable within a track along a release axis between depressed and extended positions and biased to the extended position, the release button configured to engage the catch mechanism when the removable agitator is in the coupled position and the release button is in the extended position;

wherein the base coupler includes a support surface configured to engage with a bottom surface of the agitator coupler as the agitator coupler is rocked about the fulcrum to the coupled position to support the removable agitator on the impeller base and a downwardly-projecting channel extending from the support surface;

wherein the agitator coupler includes a downwardly-projecting protrusion sized and configured to be received in the downwardly-projecting channel as the agitator coupler is rocked about the fulcrum to form a mortise and tenon joint that restricts relative rotation between the removable agitator and the impeller base about the axis of rotation; and wherein the catch mechanism is disposed at a higher elevation along the axis of rotation than the fulcrum.

* * * * *